US006694789B2

(12) United States Patent
Yamamoto et al.

(10) Patent No.: US 6,694,789 B2
(45) Date of Patent: Feb. 24, 2004

(54) METHOD AND APPARATUS FOR CONTROLLING SHOT-PEENING DEVICE

(75) Inventors: Masatoshi Yamamoto, Toyokawa (JP); Hideaki Kaga, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 0 days.

(21) Appl. No.: 10/132,176

(22) Filed: Apr. 26, 2002

(65) Prior Publication Data

US 2002/0170327 A1 Nov. 21, 2002

(30) Foreign Application Priority Data

Apr. 26, 2001 (JP) ..... 2001-129155

(51) Int. Cl.[7] ..... B24C 1/10; B24C 7/00
(52) U.S. Cl. ..... 72/53; 29/90.7; 451/39
(58) Field of Search ..... 72/53; 29/90.7; 451/39

(56) References Cited

U.S. PATENT DOCUMENTS

| | | | | |
|---|---|---|---|---|
| 4,420,957 A | * | 12/1983 | Weber | 29/90.7 |
| 4,470,292 A | * | 9/1984 | DeClark et al. | 72/53 |
| 4,848,123 A | * | 7/1989 | Thompson | 72/53 |
| 4,873,855 A | * | 10/1989 | Thompson | 72/53 |
| 5,113,680 A | * | 5/1992 | Matsuura et al. | 72/53 |

FOREIGN PATENT DOCUMENTS

| | | |
|---|---|---|
| JP | 4-19071 | 1/1992 |
| JP | 7-214472 | 8/1995 |
| JP | 2000-70863 | 3/2000 |

* cited by examiner

*Primary Examiner*—David Jones
(74) *Attorney, Agent, or Firm*—Finnegan, Henderson, Farabow, Garrett & Dunner LLP

(57) ABSTRACT

A system for shot peening that includes an enclosure in which are provided a workpiece W to be shot peened and a nozzle for projecting the shot particles. A memory stores data for maximizing the anticipated shot-peening intensity at the workpiece based on the predetermined conditions of the shot peening. Then a calculating circuitry determines the conditions of the shot peening to be carried out in the system to maximize an anticipated shot-peening intensity at the workpiece based on the stored data from the memory and the selected type of the shot-peening process to be applied to the workpiece before the shot particles have been actually projected. The nozzle is then actuated under the determined conditions such that it projects the shot particles and directs them onto the workpiece. The shot-peening intensity of the actually projected shot particles at the workpiece is measured by a measuring device. Then a calibration circuitry controls the mass-flow rate of the shot particles and the pressure or the flow rate of the compressed air to maximize the measured shot-peening intensity based on the stored data such that the nozzle projects the shot particles under the corrected and controlled conditions.

5 Claims, 4 Drawing Sheets

METHOD AND APPARATUS FOR CONTROLLING SHOT-PEENING DEVICE

FIELD OF THE INVENTION

This invention relates to a method and apparatus for controlling a shot-peening device, and, more particularly, to maximizing an impact of a collision of a stream of shot particles to be projected from a nozzle.

BACKGROUND OF THE INVENTION

In one conventional use of shot peening, a stream of shot, i.e., particles, is directed from a nozzle to the surface of a workpiece such that a collision occurs thereon. Although the impact of the collision of the stream of the shot particles can be readily controlled to be a suitable value that is needed for the workpiece, it is difficult to set such an impact for the optimal and most efficient conditions. Further, an approach to achieve such optimal and most efficient conditions of the impact causes the consumption of the energy for the shot-peening process to increase relatively.

Accordingly, there exists a need in the art for a method and apparatus for shot peening that maximizes the impact of a stream of shot, that is accurate, and that has a low consumption of energy.

SUMMARY OF THE INVENTION

Therefore, one object of the invention provides a method for controlling a shot-peening device having an enclosure in which are located a workpiece to be shot peened and at least one nozzle for projecting shot particles and for directing them onto the workpiece under specified conditions for projecting the shot particles. The conditions for projecting the shot particles are partly defined by a shot-peening process to be applied to the workpiece. The method comprises steps a) through g).

First, step a) is to acquire data for maximizing the anticipated shot-peening intensity at the workpiece based on the predetermined conditions for projecting the shot particles.

In step b), a shot-peening process to be applied to the workpiece is then selected.

In step c), the conditions for projecting the shot particles to maximize the anticipated shot-peening intensity at the workpiece are then determined based on the acquired data and the selected shot-peening process before the shot particles have been actually projected.

In step d), the shot particles are then projected and directed onto the workpiece from the nozzle under the determined conditions for projecting the shot particles.

In step e), the shot-peening intensity at the workpiece is then measured based on the actually projected shot particles.

In step f), at least some of the present conditions for projecting the shot particles to maximize the measured shot-peening intensity are controlled based on the acquired data.

In step g), the shot particles are projected and directed onto the workpiece from the nozzle under the controlled conditions for projecting the shot particles.

To increase the accuracy of the shot-peening process, steps e) through g) may be repeated a plurality of times after step g) is completed.

In one aspect of the invention, at least some of the conditions for projecting the shot particles include the mass-flow rate of the shot particles to be fed to the nozzle, and the pressure or flow rate of the compressed air to be used to project the shot particles from the nozzle.

As used herein, the term mass-flow rate of the shot particles refers to the flow rate of the mass of the shot particles.

Another object of the invention is to provide an apparatus for controlling a shot-peening device having an enclosure in which are located a support for supporting a target to be shot peened and at least one nozzle for projecting shot particles and for directing them onto the target under conditions for projecting the shot particles. The conditions for projecting the shot particles are partly defined by a shot-peening process to be applied to the target.

The apparatus comprises a) measuring means for measuring the shot-peening intensity by the actually projected shot particles at a position for measuring which is located at or near the target within the enclosure; b) storing means for storing data for maximizing the anticipated shot-peening intensity at the position for measuring based on the predetermined conditions for projecting the shot particles; means for determining the conditions for projecting the shot particles to maximize an anticipated shot-peening intensity at the position for measuring based on the stored data from the memory and a selected shot-peening process before the shot particles have been actually projected; means for operating the nozzle such that the nozzle projects the shot particles and directs them onto the target therefrom under the determined conditions for the operation thereof, and e) controlling means for controlling at least some of the present conditions for projecting the shot particles to maximize the measured shot-peening intensity based on the acquired data such that the nozzle projects the shot particles and directs them onto the target therefrom under the controlled conditions thereof.

In the embodiment of the invention the measuring means includes a sensor for sensing the kinetic energy or its equivalent of the actually projected shot particles at the position for measuring and for sending a sensing signal, and means for converting the sensing signal of the sensor into the corresponding shot-peening intensity.

The sensor may be located in the support near the target. In this case, the target is a workpiece to be shot peened.

Alternatively, the target may be a dummy workpiece in which the sensor is located.

BRIEF DESCRIPTION OF THE DRAWINGS

The accompanying drawings, which are incorporated in and constitute a part of the specification, schematically illustrate the preferred embodiment of the present invention, and together with the general description given above and the detailed description of the preferred embodiment given below serve to explain the principles of the invention.

DESCRIPTION OF THE PREFERRED EMBODIMENT

Figure 1:
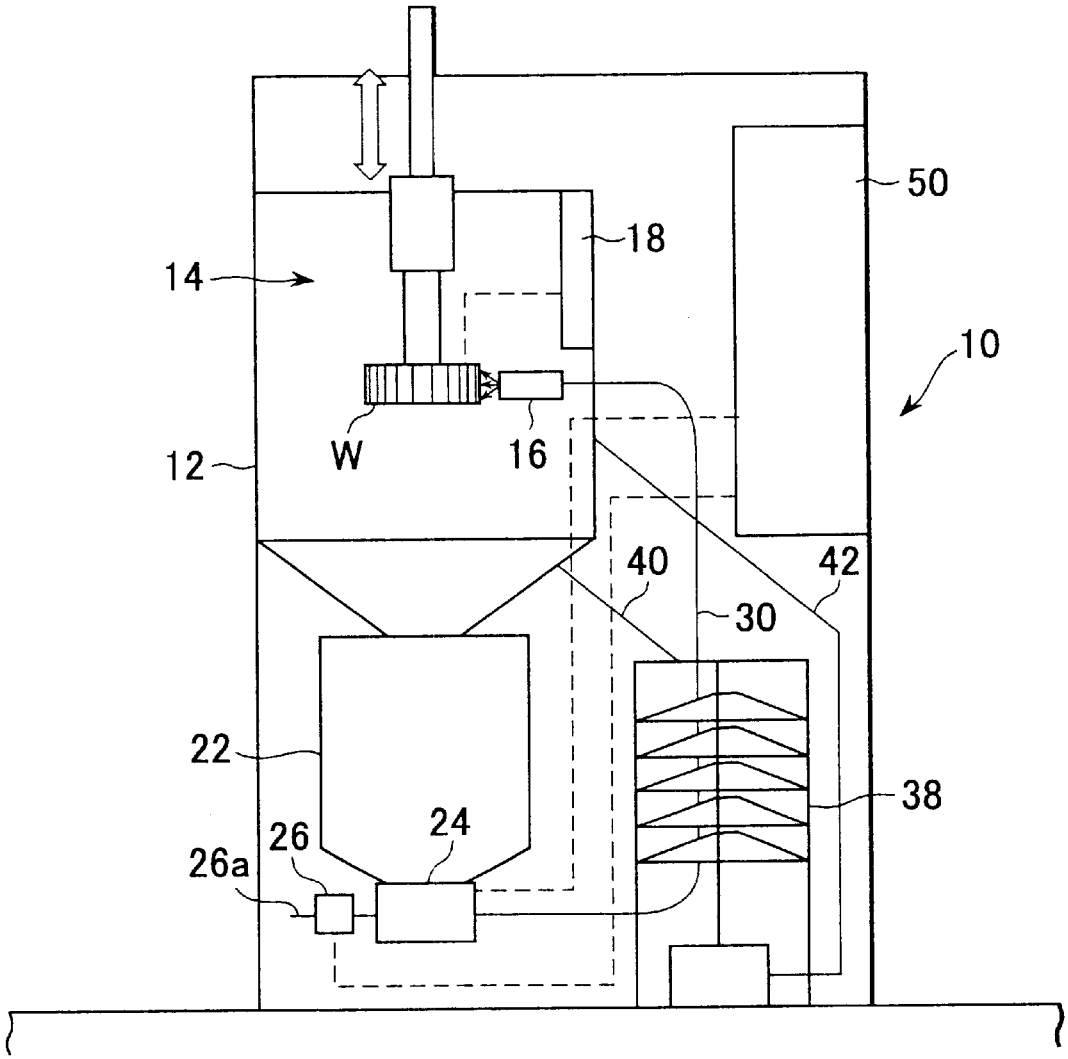
FIG. 1 is a schematic, elevational and front view of the shot-peening system of the preferred embodiment of the present invention.

FIG. 1 shows a shot-peening system 10 for controlling its shot-peening device according to the present invention.

The shot-peening device has a sealed enclosure 12. Within the enclosure is a workpiece support 14, which can be moved vertically and rotated by any known driving mechanism (none shown). A workpiece W to be shot peened is supported by the support 14 such that it can be moved with the support 14. Within the enclosure 12, a peening nozzle 16 is also located a variable distance from the surface of the supported workpiece W to be shot peened. The variable distance is adjusted by any known driving mechanism (none shown).

The shot-peening system 10 includes a measuring device 18 that is connected to a sensor, which sensor is embedded in the support 14 at the measuring point near the workpiece W. The sensor is omitted from FIG. 1, but shown in FIG. 2 as denoted by reference number 20. The sensor 20 may convert an elastic wave that is generated when a shot particle strikes the sensor 20 to an electrical signal. Based on the electrical signals from the sensor 20, the measuring device 18 measures the total peening energy. It is the product of the intensity, or kinetic energy, per the individual projected shot particle multiplied by the number of impacts of the projected shot particles on the sensor 20 per unit time.

The measuring device 18 and the sensor 20 may be ones like those disclosed in, e.g., Japanese Patent Early-Publication Nos. 07-214472 (Oota), and 04-019071 (Matsuura, et al.) or any similar devices. The corresponding applications of these publications are assigned to the assignee of the present application.

Immediately under the enclosure 12, the system 10 includes a hopper 22 for storing the shot particles. The bottom of the hopper 22 has a vent opening. It communicates with one port (a receiving port) of a three-port flow regulator 24 for regulating the mass-flow rate of the shot particles from the hopper 22. The three-port flow regulator 24 may be electric-mechanical, or an electric-magnetic mechanical regulator. Of the remaining two ports of the three-port flow regulator, one port communicates with a compressed gas source (typically, a compressed air source, but none is shown) via a pressure/flow valve 26 and a first piping 26*a*, while the other port communicates with the peening nozzle 16 in the enclosure 12 via a second piping 30. Between the first piping 26*a* and the nozzle 16, a pressure sensor 36 (it is omitted from FIG. 1, but shown in FIG. 2) is provided. The pressure/flow valve 26 may be replaced with a pressure valve or a flow valve.

Preferably, the shot-peening system 10 also includes a classifier 38, such as the type having stacked rotating disks and disclosed in, e.g., Japanese Patent Early-Publication No. 2000-70863 (Oota, et al.), which was assigned to the assignee of the present application, or any similar devices. The classifier 38 classifies the shot particles by the ranges of the sizes (each range may include different size particles) and sphericities such that the workpiece W can be shot peened with a higher accuracy. The type of classifier 38 in Oota, et al., classifies the shot particles based on the friction factor between the upper surface of each rotating disk and each shot particle, and the differences in the speeds of rotation of the rotating disk between positions in the radial direction of it.

On the upper portion of the classifier 38, its inlet communicates with the bottom of the enclosure 12 via a guiding conduit 40 such that the projected shot particles in the enclosure 12 partly flow into the classifier 38, and thus are classified therein. In turn, a vent opening of the classifier 38 communicates with the enclosure 12 via a return conduit 42 for conveying the classified shot particles such that they return to the enclosure 12.

Figure 2:
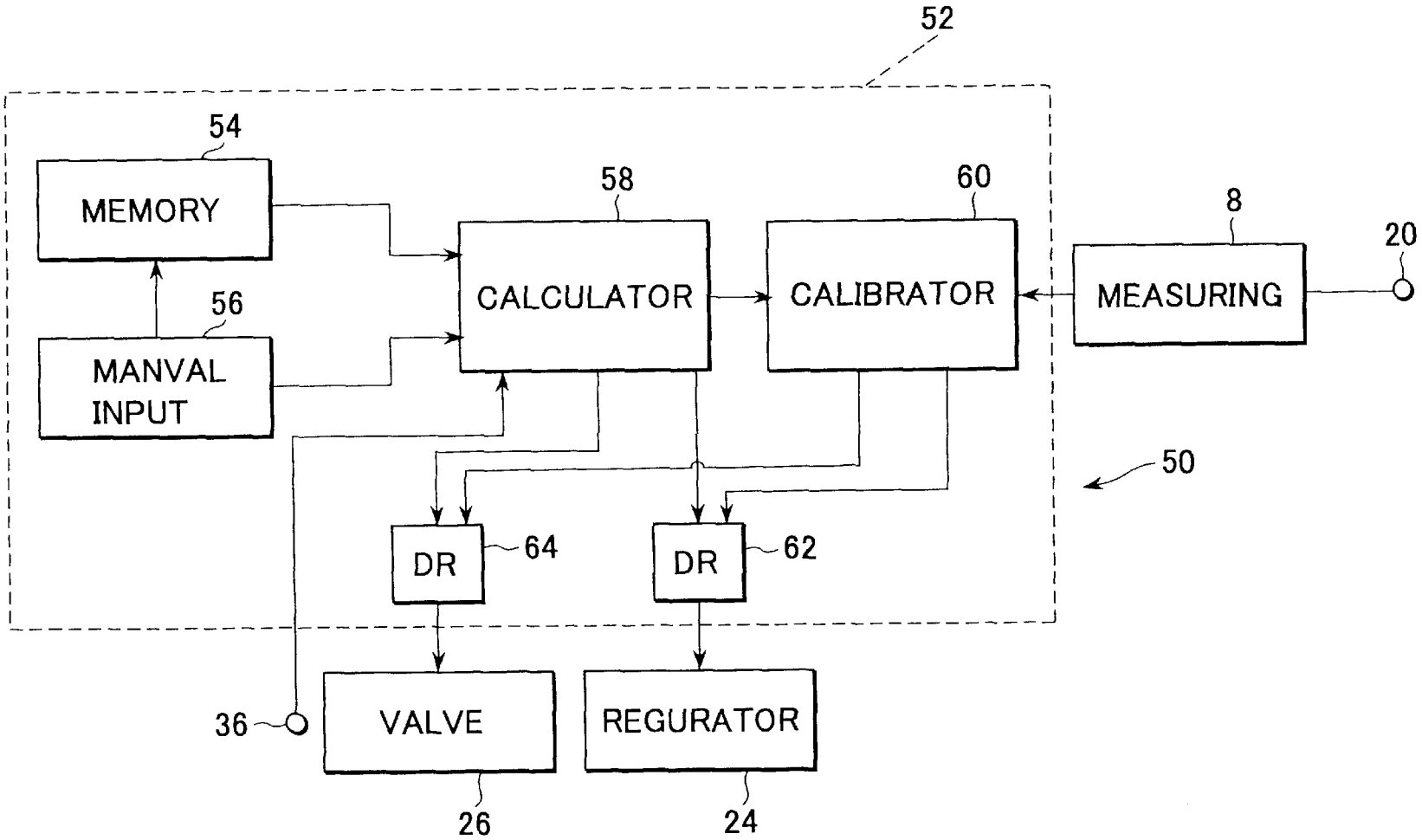
FIG. 2 is a schematic block diagram of the controller for the shot-peening system of FIG. 1.

In reference to FIG. 2, the shot-peening system 10 also includes a control panel 50, which includes a main controller, such as a computer 52. The computer 52 includes a memory 54, a manual input device 56, such as a keyboard, which a human operator can use to provide data or information to the computer 52, a calculating circuitry or calculator 58, a calibration circuitry or calibrator 60, a driver 62 for controlling the three-port flow regulator 24, and a driver 64 for controlling the pressure/flow valve 26. The computer 52 may also include a display (not shown) for displaying any data or controlling parameters from the memory 54, the manual input device 56, the calculating circuitry 58, and the calibration circuitry 60.

The computer 52 shown herein is just an example. The diagram of it explains the invention. The calculating circuitry 58 and the calibration circuitry 60 may be a common processor or separate processors. The drivers 62 and 64 may include computer software.

Figure 3:
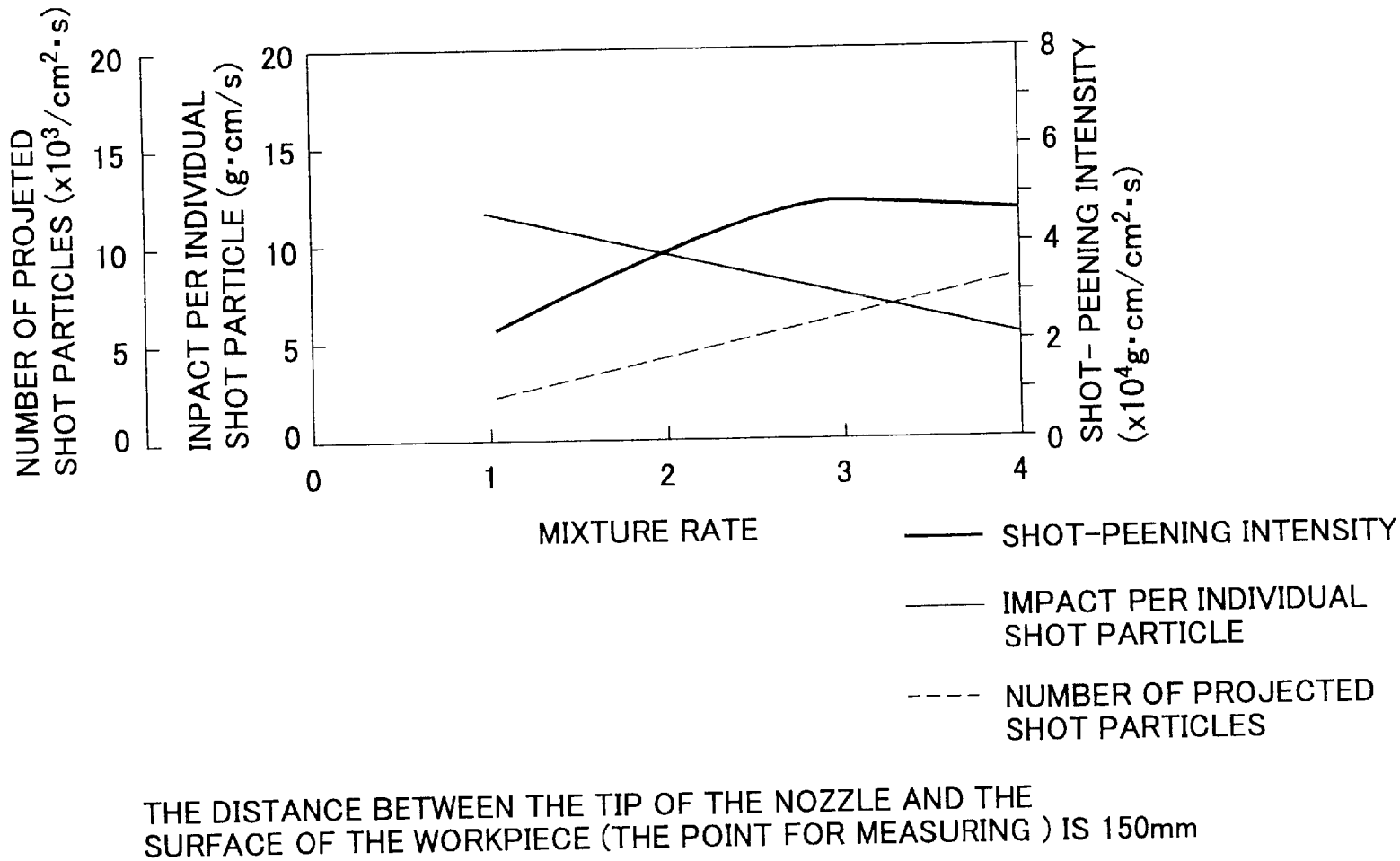
FIG. 3 shows graphs to indicate variations in impacts of a stream of shot based on variations in the proportion of the shot in relation to compressed air.

The memory 54 stores correlation functions between predetermined conditions for projecting the shot particles and the ideal maximum values of the total peening energies based on the corresponding predetermined conditions. Examples of the correlation functions are shown in FIG. 3.

Figure 4:
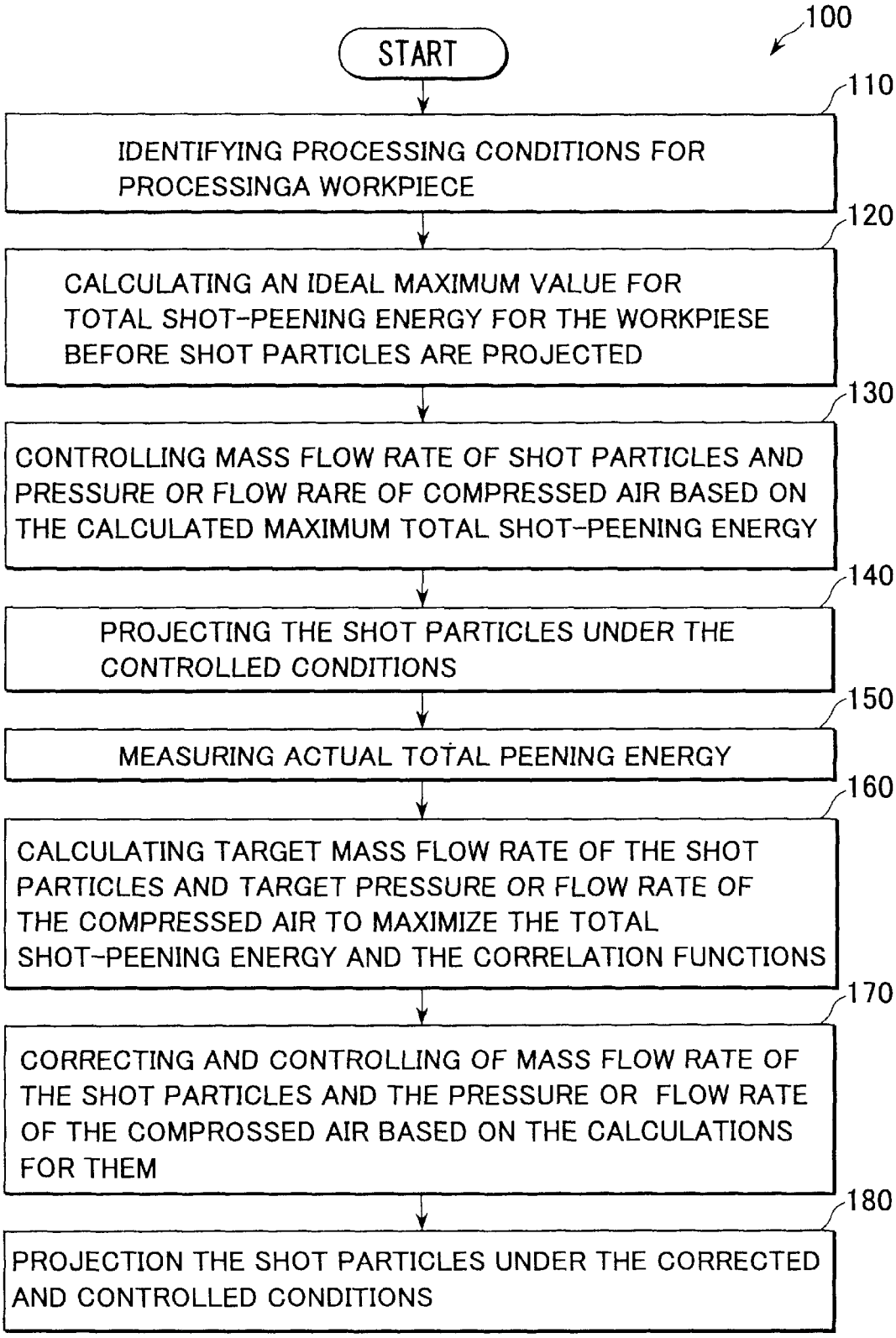
FIG. 4 is a flowchart that illustrates the steps of the shot-peening process to carry out the method of the invention.

FIG. 4 is a flowchart 100 that illustrates the steps of the shot-peening process in accordance with the method of the invention. The shot-peening system 10 or any similar device can be used in the steps as shown in the flowchart 100.

As shown in step 110 of FIG. 4, the operator provides the computer 52 information that identifies conditions for processing the workpiece W to be processed via the manual input device 56. The conditions for processing the workpiece W include the pressure of the compressed air for projecting the shot particles, the bore diameter of the nozzle 16, and the diameter, the specific gravity, and the hardness of the individual shot particle to be projected. Further, the conditions for processing the workpiece W also include conditions for the system that are independent from the workpiece W, but dependent on the shot-peening system 10. The conditions for the system include the type of the path or the conduit for conveying the shot particles.

The information can then be provided to the calculating circuitry 58 in step 120. As shown in step 120, the calculating circuitry 58 then calculates the ideal maximum value for the total peening energy for the workpiece W that is to be shot peened based on the information from the manual input device 56 and the correlation functions retrieved from the memory 54.

To save the labor of the operator in step 110, it is understood that at least some of the conditions for processing the workpiece W can be permanently stored in the memory 54. The stored condition(s) is provided to the calculating circuitry 58 from the memory 54 in step 120. In this case, the manual input device 56 may include, e.g., a switch or switches (none shown), which the operator can use to select the stored condition(s) in the memory 54.

Once the ideal maximum value for the total peening energy is calculated, this result can then be provided to the driver 62 of the regulator 24 and the driver 64 of the pressure/flow valve 26 in step 130. As shown in step 130, the drivers 62 and 64 control the regulator 24 and the pressure/flow valve 26 based on the result calculated by the calculating circuitry 58.

As shown in step 140, the nozzle 32 then projects the shot particles under the conditions that are determined in step 130.

Once the shot particles are projected, they strike the sensor 20, and thus the measuring device 18 measures the total peening energy as shown in step (measuring step) 150.

The measured total peening energy is then provided to the calibration circuitry 60 in step 160. As shown in step 160, the calibration circuitry 60 then calculates the target mass-flow rate of the shot particles and the target pressure or the target flow rate of the compressed air to maximize the total peening energy based on the measured total peening energy provided by the measuring device 18 and the correlation functions retrieved from the memory 54.

Once the target mass-flow rate of the shot particles and the target pressure or the target flow rate of the compressed air that is necessary to maximize the total shot-peening energy are calculated, they can be used as calibration values to make feedback controls in step 170. As shown in step 170, the calibration values are provided to the corresponding drivers 62 and 64 from the calibration circuitry 60. The drivers 62 and 64 then control the regulator 24 and the pressure/flow valve 26 based on the calibration values.

As shown in step 180, the nozzle 32 then projects the shot particles under the control conditions that are determined in step 170. Then the process returns to the measuring step 150 in order to measure the total peening energy again. Based on the new measured total peening energy, steps 160–180 are also carried out again. Then steps 150–180 are repeated many times in order to increase the reliability and accuracy for the maximum total peening energy generated in the shot-peening system 10.

During the shot-peening process, some of the projected shot particles within the enclosure 12 that are projected from the nozzle 16 flow into the inlet of the classifier 36 via the guiding conduit 40. The classifier 38 classifies the shot particles in the enclosure 12 and returns the classified shot particles to the enclosure 12 via the return conduit 40.

It is assumed that the pressure of the compressed air is selected for the given diameter of the bore of the nozzle 16, and the given diameter, the given specific gravity, and the given hardness of each individual shot particle in step 110 of FIG. 4. It is also assumed that the shot particles are then projected when the distance between the tip of the nozzle 16 and the surface of the workpiece W to be shot peened is 150 mm. Under these conditions, it is can be seen from the graphs of FIG. 3 that a mixture rate by volume of the shot particles to the compressed air to maximize the total shot-peening energy is 1:3. If the distance between the tip of the nozzle 16 and the surface of the workpiece W is 220 mm, the total shot-peening energy can be maximized when the mixture rate by volume of the shot particles to the compressed air is 1:3. Thus, this mixture rate is the most efficient rate for the conditions for projecting the shot particles.

During the shot-peening process, it is possible that the pressure of the compressed air will be decreased due to a temporary over consumption of the air from the air source after the ideal maximum value of the total shot-peening energy is once calculated at step 120. In such a case, the ideal maximum value may be recalculated based on the decreased pressure of the compressed air. The recalculated ideal maximum value can then be used as a new condition for projecting the shot particles. Therefore, the ideal maximum value of the total peening energy within a required range of the shot-peening intensity for the workpiece to be processed may be specified with a higher accuracy.

It is also possible that the pressure of the compressed air will be significantly decreased to a value that cannot satisfy the required range of the shot-peening intensity for the workpiece to be processed. To deal with such a case, the shot-peening system 10 may be configured so that the operator will notice such a condition, by the system 10 generating an alarm that indicates that an abnormal pressure has occurred.

It should be understood that various modifications and variations within the scope of this invention can be made by one of ordinary skill in the art without departing from the scope and sprit thereof as defined by the appended claims.

For example, in the above embodiment, the sensor 20 is embedded in the support 14 near the workpiece W. Alternatively, the sensor 20 may be embedded in a dummy workpiece (not shown) rather than in the support 14. This dummy workpiece with the sensor 20 may be configured such that it can be detachably mounted on the support 14 and used at the step for detecting the shot-peening intensity so that the measuring point can be assumed to be positioned on the real workpiece to be shot peened. In this case, the sensor 20 detects the shot-peening energy at the position for measuring that is located at the dummy workpiece. Thus, the resulting shot-peening energy can be assumed to correspond to the peening energy on the real workpiece.

Although the embodiment employs the single nozzle 16, a plurality of nozzles may be employed.

What is claimed is:

1. A method for controlling a shot-peening device having an enclosure in which are located a workpiece to be shot peened and at least one nozzle for projecting shot particles and directing them onto the workpiece under determined conditions for projecting the shot particles wherein the conditions for projecting the shot particles are partly defined by a shot-peening process to be applied to the workpiece, the method comprising the steps of:

a) acquiring data for maximizing anticipated shot-peening intensity at the workpiece based on the predetermined conditions for projecting the shot particles;

b) selecting a shot-peening process to be applied to the workpiece;

c) determining the conditions for projecting the shot particles to maximize an anticipated shot-peening intensity at the workpiece based on the acquired data and the selected shot-peening process before the shot particles have been actually projected, wherein at least some of the conditions for projecting the shot particles include a mass-flow rate of the shot particles to be fed to the nozzle, and a pressure or a flow rate of the compressed air to be used to project the shot particles from the nozzle;

d) projecting the shot particles and directing them onto the workpiece from the nozzle under the determined conditions for projecting the shot particles;

e) measuring the shot-peening intensity at the workpiece based on the actually projected shot particles;

f) controlling at least some of the present conditions for projecting the shot particles to maximize the measured shot-peening intensity based on the acquired data;

g) projecting the shot particles and directing them onto the workpiece from the nozzle under the controlled conditions for projecting the shot particles, and h) detecting any undesirable change in the pressure of the compressed air, and carrying out steps c) through g) based upon any detected undesirable change in the pressure of the compressed air.

2. The method of claim 1 further comprising repeating steps e) through g) a plurality of times after step g) is completed.

3. A system for shot peening comprising:

a) a container for containing shot particles and supplying them at a variable mass-flow rate therefrom;

b) an enclosure for enclosing a target to be shot peened;

c) a support for rotating and supporting the target within the enclosure;

d) at least one nozzle for projecting shot particles that are supplied from the container, and directing them onto the supported and rotating target within the enclosure by applying compressed air, wherein either the pressure or the flow rate of the compressed air is variable;

e) storing means for storing data for maximizing an anticipated shot-preening intensity at a position for measuring which is located at or near the supported and rotating target within the enclosure based on the predetermined conditions of the shot peening, wherein the predetermined conditions of the shot peening include at least the mass-flow rate of the shot particles, the pressure or flow rate of the compressed air, and the type of the shot-peening process to be applied to the target;

f) determining means for determining the conditions of shot peening to be carried out in the system to maximize an anticipated shot-peening intensity at the position for measuring based on the stored data from the memory and a selected type of the shot-peening process to be applied to the target before the shot particles have been actually projected;

g) actuating means for actuating the nozzle under the determined conditions such that the nozzle projects the shot particles and directs them onto the supported and rotating target therefrom;

h) measuring means for measuring a shot-peening intensity of the actually projected shot particles at the position for measuring;

i) controlling means for controlling the mass-flow rate of the shot particles and the pressure or the flow rate of the compressed air to maximize the measured shot-peening intensity based on the sorted data such that the nozzle projects the shot particles and directs them onto the target therefrom under the controlled conditions thereof; and j) detecting means for detecting any change in the pressure of the compressed air to be supplied to the nozzle.

4. The system of claim 3 wherein the determining means again determines the conditions of shot-peening to be carried out in the system to maximize an anticipated shot-peening intensity at the position for measuring when the detecting means detects any change in the pressure of the compressed air to be supplied to the nozzle.

5. The system of claim 3 wherein the system generates an alert when the detecting means detects the predetermined change in the pressure of the compressed air to be supplied to the nozzle.

* * * * *